United States Patent [19]

Lange et al.

[11] Patent Number: 5,045,512

[45] Date of Patent: Sep. 3, 1991

[54] MIXED SINTERED METAL MATERIALS BASED ON BORIDES, NITRIDES AND IRON BINDER METALS

[75] Inventors: Dietrich Lange, Kempten, Fed. Rep. of Germany; Lorenz Sigl, Breitenwang, Austria; Karl-Alexander Schwetz, Sulzberg, Fed. Rep. of Germany

[73] Assignee: Elektroschmelzwerk Kempten GmbH, Munchen, Fed. Rep. of Germany

[21] Appl. No.: 608,231

[22] Filed: Nov. 2, 1990

[30] Foreign Application Priority Data

Dec. 15, 1989 [DE] Fed. Rep. of Germany ..... 3941536

[51] Int. Cl.[5] ..... C04B 35/58; C04B 35/52/35/48; C04B 35/02

[52] U.S. Cl. ..... 501/96; 501/87; 501/92; 501/94; 501/95; 501/102; 501/103

[58] Field of Search ..... 501/87, 92, 94, 95, 501/96, 102, 103

[56] References Cited

U.S. PATENT DOCUMENTS

| | | | |
|---|---|---|---|
| 4,259,119 | 3/1981 | Watanabe et al. | 106/55 |
| 4,379,852 | 4/1983 | Watanabe et al. | 501/87 |
| 4,636,481 | 1/1987 | Kida et al. | 501/96 |
| 4,889,836 | 12/1989 | Buljan et al. | 501/97 |
| 4,929,417 | 5/1990 | Watanabe et al. | 419/12 |

*Primary Examiner*—William R. Dixon, Jr.
*Assistant Examiner*—Michael A. Marcheschi
*Attorney, Agent, or Firm*—Burgess, Ryan & Wayne

[57] ABSTRACT

The invention relates to mixed sintered metal materials based on high-melting borides and nitrides and low-melting iron binder metals having the composition:

(1) 40–97% by volume of borides, such as titanium diboride and zirconium diboride;

(2) 1–48% by volume of nitrides, such as titanium nitride and zirconium nitride;

(3) 0–10% by volume of oxides, such as titanium oxide and zirconium oxide, with the proviso that components (2) and (3) may also be present as oxynitrides such as titanium and zirconium oxynitride; and (4) 2–59% by volume of low-carbon binder metals, such as iron and iron alloys and to processes for preparing the same.

15 Claims, No Drawings

MIXED SINTERED METAL MATERIALS BASED ON BORIDES, NITRIDES AND IRON BINDER METALS

FIELD OF THE INVENTION

The present invention is directed to mixed sintered metal materials based on borides, nitrides and iron binder metals and to processes for preparing the same.

BACKGROUND OF THE INVENTION

Sintered hardmetals, which are understood as sintered materials consisting of metallic sintered materials based on high-melting carbides of the metals from Groups 4b to 6b of the Periodic Table and low-melting binder metals from the iron group, in particular cobalt, have been known for a long time. They are mainly used for the machining technology and for controlling wear. For producing these sintered hardmetals from the usually pulverulent sintering materials, the metal binders are necessary which must wet the sintering material during the sintering process with alloy formation (solution). It is only in this way that the tough/hard microstructure of the sintered hardmetals, of which the WC-Co and TiC-WC-Co systems are best known, suitable for use is formed. It is also known that binders from the iron group are also suitable for other high-melting metallic sintered materials such as borides and nitrides (compare "Ullmanns Enzyklopädie der techn. Chemie [Ullmann's Encyclopedia of Industrial Chemistry]", Vol. 12, 4th Edition, 1976, Chapter "Sintered Metals," pgs. 515–521).

The systems $TiB_2$—Fe, Co or Ni and $ZrB_2$ and Fe, Co or Ni have already been investigated in the 60's. It was then found that such alloys based on $TiB_2$ with up to 20% Fe as binder are considerably harder than those based on WC-Co and TiC-WC-Co. Alloys based on $ZrB_2$ with Co and Ni are brittle and not resistant to oxidation, whereas Fe reacts with $ZrB_2$ to form tetragonal $Fe_2B$ and can thus not be used as a binder (compare papers by V.F. Funke, et al and M.E. Tyrrell, et al, abstracted in the book "Boron and Refractory Borides", edited by V.J. Matkovich, Springer-Verlag, Berlin-Heidelberg-New York, 1977, in Chapter XIV, pg. 484, in conjunction with Table 7 and pg. 488, in conjunction with Table 8).

It was concluded from these results that evidently the suitable binder, which might compensate the disadvantages of the excessive brittleness and thus allow industrial use of such alloys in the field of cutting materials and other applications with high demands on the corrosion resistance, heat resistance and/or oxidation resistance, for these borides, had not yet been found (compare loc. cit., pg. 489).

Alloys based on nitrides and carbonitrides of titanium and zirconium with a very high proportion of the binder, in particular iron, (at least 50% and higher) are particularly tough, but no longer very hard (HV 1050–1175) (compare U.S. Pat. No. 4,145,213 to Oskarsson, et al). Presumably, such materials are indeed less brittle than the abovementioned boride-based systems. Because of their low hardness, however, they are unsuitable for machining hard and high temperature-resistant materials such as Sic-reinforced aluminium alloys.

Combinations based on diborides, in particular of titanium and zirconium, with carbides and/or nitrides, in particular titanium nitride and titanium carbide, and with boride-based binders such as in particular Co boride, Ni boride or Fe boride, do not lead to a solution of the problem, since although such materials are very hard and strong because of the boride binder, which is to be understood in particular as CoB, they are particularly brittle instead (compare U.S. Pat. No. 4,379,852 to Watanabe, et al).

Finally, attempts have also already been made to add graphite, which is intended to react with oxygen present during the sintering step, to the known system based on titanium boride and, if appropriate, titanium carbide with binders of iron, cobalt and nickel or alloys thereof before the mixture is sintered. In this way, it is said that cutting materials can be obtained which are both sufficiently hard and tough, so that they can be used in particular for the machining of aluminium and aluminium alloys (compare EP-B-148,821 of Moskowitz, et al, which is based on PCT Application No. WO 84/04,713). By the reaction of graphite with titanium boride in the presence of iron, however, the formation of the undesired $Fe_2B$ phase is promoted, which is not only less hard than titanium diboride but also reduces the proportion of the ductile iron binder phase, so that the materials resulting from this are not only less hard, but also less tough.

It is therefore the object to provide mixed sintered hardmetal materials based on high-melting borides and nitrides of metals from Group 4b of the Periodic Table and low-melting binder metals consisting of iron or iron alloys, which are highly dense, very hard, tough and strong so that they can be used in particular as cutting materials for hard and high temperature-resistant materials.

SUMMARY OF THE INVENTION

The mixed materials according to the invention comprise:

(1) 40 to 97% by volume of borides selected from the group consisting of titanium diboride, zirconium diboride and solid solutions thereof, (2) 1 to 48% by volume of nitrides selected from the group consisting of titanium nitride and zirconium nitride, (3) 0 to 10% by volume of oxides selected from the group consisting of titanium oxide and zirconium oxide, with the proviso that components (2) and (3) may be present, completely or partially, in the form of oxynitrides, selected from the group consisting of titanium oxynitrides and zirconium oxynitrides, and (4) 2 to 59% by volume of low-carbon iron and iron alloys; and have the following properties:

density at least 97% theoretical density, relative to the theoretically possible density of the total mixed material, grain size of the sintered material phase at most 5.5 um, hardness (HV 30) of at least 1,200, bending fracture strength (measured by the 4-point method at room temperature) at least 1,000 MPa, and fracture resistance $K_{IC}$ at least 8.0 MPa $1^{\frac{1}{2}}$.

Mixed sintered metal materials in which the sintered material components consist of titanium boride and titanium nitride, which together make up 50–97% by volume, preferably 50–90% by volume, and especially about 80% by volume, of the total mixed material have proved particularly suitable. Preferably, 2.5–40% by volume of the sintered material components consist of titanium nitride. The remainder, to make 100% by volume in the total mixed material, is distributed over the oxides which may be present, if appropriate, preferably titanium dioxide, in a proportion of between 0 and 10% by volume, and the metallic binder phase consisting of the low-carbon iron or iron alloy. The alloy elements for low-carbon iron grades are preferably chromium or chromium/nickel mixtures.

The mixed sintered metal materials according to the invention can be produced by processes known per se, for example, by sintering without pressure of fine starting powder mixtures or by infiltration of porous shaped bodies of the sintered material components with the low-carbon binder.

For carrying out these processes, very fine and very pure starting powders are advantageously used as a starting material. The borides and nitrides selected as the sintering material components should be as free as possible of carbon-containing impurities which have an adverse effect on the formation of the microstructure in the finished sintered body. Thus, for example, titanium diboride which can contain boron carbide resulting from the preparation, can react during the sintering step in the presence of iron not only with graphite, as already mentioned above, but also with boron carbide to form the undesired $Fe_2B$ phase, as shown by the following equations:

$$TiB_2+4Fe+C \rightarrow TiC+2Fe_2B \quad (1)$$

$$TiB_2+12Fe+B_4C \rightarrow TiC+6Fe_2B \quad (2)$$

However, oxygen, which is mainly present in the form of adhering oxides does not necessarily interfere and can be tolerated up to about 2% by weight in the starting powders. The adhering oxides include oxides of titanium and zirconium, such as $TiO_2$, $Ti_2O_3$ and/or TiO, and the respective oxides of zirconium. Th s, even with up to 10% by volume of $TiO_2$ present in the finished mixed material, hard and dense bodies are obtained. Oxygen may also be present, completely or partially, in the form of oxynitrides of titanium and zirconium. The oxynitrides include titanium and zirconium nitrides wherein some of the nitrogen atoms are replaced by oxygen atoms according to the formulae Ti (O,N) and Zr (O,N). This is because nitrogen and oxygen are interchangeable within the titanium nitride and zirconium nitride lattice, respectively, by forming solid solutions.

The preferred low-carbon binder metals are iron grades having a C content of less than 0.1 and preferably, less than 0.05% by weight. Carbonyl iron powders having an Fe content from 99.95 to 99.98% by weight have proved particularly suitable. These low-carbon iron grades can contain as alloy constituents, for example, chromium in quantities of about 12% by weight or nickel/chromium mixtures of, for example, about 8% by weight of nickel and about 18% by weight of chromium.

In order to avoid contamination, especially with carbon, it is advantageous to grind these starting powders autogenously which must have an adequate purity even from the preparation. For this purpose, known grinding units can be used such as ball mills, planetary ball mills and attritors, in which the grinding bodies and grinding vessels consist of a material identical to the process material which is to be understood in the present case as, for example, titanium diboride and low-carbon iron grades.

In grinding with grinding bodies of titanium diboride, in particular coarse starting powders can be comminuted down to the desired grain fineness while grinding bodies of low-carbon iron grades are suitable for adequate mixing of the starting powders since the comminution effect of the sintering material components is here only small. In this case, the desired grain size distribution of the starting powders must therefore already exist before grinding.

If necessary, temporary binders or pressing aids are added to the powder mixtures obtained after mixing-grinding, and the mixtures are rendered free-flowing by spray-drying. They are then pressed by conventional measures such as cold-isostatic pressing or by die-pressing to form green compacts of the desired shape and having a density around 60% theoretical density. Binders and/or pressing aids are removed, without leaving a residue, by a heat treatment at 400° C. The green compacts are then heated, in the absence of oxygen, to temperatures in the range from 1350° C. to 1900° C., preferably from 1550° C. to 1800° C., and held at this temperature for 10 to 150 minutes, preferably 15 to 45 minutes, until a liquid iron-rich phase has formed, and then slowly cooled to room temperature. This sintering step is advantageously carried out in furnace units which are fitted with metallic heating elements for example, of tungsten, tantalum or molybdenum, in order to avoid undesired carburization of the sintered bodies.

Subsequently, the sintered bodies can, preferably before cooling to room temperature, by applying pressure by means of a gaseous pressure transmission medium such as argon, be heated for an additional 10 to 15 minutes at temperatures from 1200° C. to 1400° C. under a pressure from 150 to 250 MPa, preferably about 200 MPa. As a result of this unconfined, hot-isostatic recompaction, virtually all pores still present are eliminated so that the finished mixed sintered metal material has a density of 100% theoretical density.

As an alternative to this sintering step, the sintering material components, for example titanium boride, titanium nitride and, if appropriate, titanium oxide, can be ground per se autogenously and these powder mixtures can be pressed with shaping to give green compacts having a density of 50 to 60% theoretical density. These porous green compacts are then surrounded in a refractory crucible for example of boron nitride or alumina, a powder fill which contains the desired binder metal and which only partially covers the surface of the porous body. The crucibles are then heated in furnace units having metallic heating elements (W, Ta, Mo) in a vacuum free of carbon impurities to temperatures above the melting point of the metallic binder phase, the molten binder metal penetrating by infiltration into the porous green compact, until the pores thereof are virtually completely closed. In this case too, virtually pore-free mixed materials are obtained which likewise have a density of almost 100% theoretical density. The time required for this is determined essentially by the time needed to fuse the binder metal. Depending on the size of the workpiece, the process is, in general, complete within a period of from 30 seconds to 30 minutes.

The mixed sintered metal materials according to the invention produced in this way are not only very dense, but also very hard, tough and strong. The desired combination of toughness and hardness can be varied within a wide range via the mixing ratio of the sintering materials since, for example, titanium nitride is somewhat tougher at a slightly lower hardness, as compared with titanium diboride. Thus, for example, the crater wear normally occurring in throw-away cutting-tool tips can be already considerably reduced by small additions of titanium nitride even though such an influence was not to be expected from a sintering material component which is softer relative to titanium diboride.

Owing to the combination of properties which can in each case be precisely adapted to the desired application, the mixed materials according to the invention are equally suitable as cutting tools for machining very hard materials, for example, SiC-reinforced aluminum alloys and nickel-based superalloys, as for impact-free working, such as core-drilling or sawing of silica-containing building materials, for example, concrete.

The preparation of mixed sintered metal materials according to the invention is described in more detail in the examples which follow.

Sintering materials and binder metals having the following powder analyses were used in Examples 1 to 7:

TABLE 1

| Powder analyses of sintering material (% by weight) | | |
|---|---|---|
| Element | $TiB_2$ | TiN |
| Ti | 67 | >77 |
| B | 30.3 | — |
| N | 0.08 | 21.5 |
| O | 1.06 | 0.58 |
| C | 0.1 | 0.1 |
| Fe | 0.14 | 0.02 |

TABLE 2

| Powder analyses of binder metal (% by weight) | | | | | | | |
|---|---|---|---|---|---|---|---|
| Example No. | 1 | 2 | 3 | 4 | 5 | 6 | 7 |
| Fe | >99.5 | >99.5 | >99.5 | >99.5 | >73.8 | >99.5 | >99.5 |
| Ni | 0 | 0 | 0 | 0 | 18 | 0 | 0 |
| Cr | 0 | 0 | 0 | 0 | 8 | 0 | 0 |
| C | <0.02 | <0.02 | <0.02 | <0.02 | <0.05 | <0.05 | <0.05 |

EXAMPLE 1

1350 g of titanium diboride having a mean particle size of 5 μm, 50 g of titanium nitride having a mean particle size of 2 μm and 600 g of carbonyl iron powder having a mean particle size of 20 μm were ground together with 2 g of paraffin and 10 $dm^3$ of heptane for 2 hours at 120 rpm in a grinding vessel of hot-pressed titanium diboride with grinding balls of titanium diboride. A free-flowing powder was prepared from the comminuted powder mixture having a mean particle size of 0.7 μm (FSSS), and this was pressed under a pressure of 320 MPa in a die press to give green compacts in the form of rectangular plates having dimensions of 53×23 mm. The green compacts were then dense-sintered for 30 minutes at 1700° C. in a furnace with tungsten heating elements in vacuo in the presence of a carbon-free residual gas and then slowly cooled to room temperature.

EXAMPLE 2

1570 g of titanium diboride having a mean particle size of 5 μm, 110 g of titanium nitride of the same particle size and 300 g of carbonyl iron powder having a mean particle size of 20 μm were ground together with 1% by weight of paraffin and 10 $dm^3$ of heptane for 2 hours at 120 rpm in a grinding vessel of V2A stainless steel with carbonyl iron balls. The powder mixture thus obtained was processed and sintered as described in Example 1.

EXAMPLE 3

Green compacts in the form of plates were prepared from the same quantities of titanium diboride, titanium nitride and carbonyl iron under the same conditions as described in Example 1, and these were sintered for 15 minutes at 1650° C. in a carbon-free vacuum. After lowering the temperature to 1200° C., these pre-sintered plates were hot-isostatically recompacted for 15 minutes in the same furnace chamber under an argon gas pressure of 200 MPa and then cooled slowly to room temperature.

EXAMPLE 4

1300 g of titanium diboride and 175 g of titanium nitride having a mean particle size of <10 μm were ground together with 10 $dm^3$ of heptane for 2 hours at 120 rpm in a grinding vessel of titanium diboride and grinding balls of titanium diboride. The comminuted sintering material powder mixture was then cold-isostatically pressed in a rubber envelope to give green compacts having a density of 60% theoretical density. These green compacts were placed into an alumina crucible and surrounded by a powder mixture of carbonyl iron which reached up to about 2 cm below the upper edge of the compacts. The crucibles were then heated to 1700° C. in a furnace with tungsten heating elements in a carbon-free vacuum and held for 30 minutes at this temperature. During this time, the porous green compact absorbs molten iron until the pores are virtually completely closed.

EXAMPLE 5

The same quantities of titanium diboride and titanium nitride as in Example 1 were ground and further processed with 600 g of a powder of stainless steel containing 18% by weight of nickel, 8% by weight of chromium and <0.05% by weight of carbon and having a starting mean particle size of 20 μm under the same conditions as in Example 1. Sintering was carried out at a temperature of 1650° C.

EXAMPLE 6

1030 g of titanium diboride (60% by volume), 206 g of titanium nitride (10% by volume), 164 g of titanium dioxide (10% by volume) and 600 g of carbonyl iron powder, the starting powders each having a mean particle size of <30 μm, were ground and further processed as described in Example 1.

EXAMPLE 7

687 g of titanium diboride (40% by volume), 824 g of titanium nitride (40% by volume) and 600 g of carbonyl iron powder (20% by volume of Fe), the starting powders each having a mean particle size of <30 μm, were ground for 2 hours at 120 rpm in a grinding vessel of V2A stainless steel and carbonyl iron balls. Further processing was carried out as described in Example 1.

The mixed sintered metal materials prepared in Examples 1 to 7 were analyzed and tested for their mechanical properties. The results are compiled in Tables 3 and 4.

TABLE 3

| | Characterization of the sintered bodies | | | | | | |
|---|---|---|---|---|---|---|---|
| Example No. | 1 | 2 | 3 | 4 | 5 | 6 | 7 |
| % by volume of sintered material | 80 | 90 | 80 | 50 | 80 | 80 | 80 |
| % by volume of $TiB_2$ | 78 | 85 | 78 | 45 | 78 | 60 | 40 |
| % by volume of TiN | 2 | 5 | 2 | 5 | 2 | 10 | 40 |
| % by volume of $TiO_2$ | — | — | — | — | — | 10 | — |
| Grain size of the sintered material [μm] | 2.5 | 5.5 | 3.0 | 2.5 | 2.3 | 2.1 | 2.0 |
| Grain size of the binder phase [μm] | 1.6 | 3.5 | 1.9 | 1.0 | 1.5 | 1.5 | 1.8 |
| Relative density [% theoretical density | 99.1 | 98.9 | 99.8 | 98 | 98.7 | 98.5 | 99.2 |

TABLE 4

| | Mechanical properties | | | | | | |
|---|---|---|---|---|---|---|---|
| Example No. | 1 | 2 | 3 | 4 | 5 | 6 | 7 |
| HV 30 Hardness | 1810 | 2080 | 1750 | 1220 | 1760 | 1790 | 1620 |
| Bending fracture strength [MPa] | 1250 | 1020 | 1350 | 1850 | 1400 | 1200 | 1350 |
| Fracture Resistance $K_{IC}$ [MPa $\sqrt{m}$] | 9.2 | 8.1 | 9.3 | 16.3 | 10.2 | 9.0 | 10.3 |

What is claimed is:

1. Mixed sintered metal materials comprising:

(1) 40 to 97% by volume of borides selected from the group consisting of titanium diboride, zirconium diboride and solid solutions thereof;

(2) 1 to 48% by volume of nitrides selected from the group consisting of titanium nitride and zirconium nitride;

(3) 0 to 10% by volume of oxides selected from the group consisting of titanium oxide and zirconium oxide, wherein components (2) and (3) may be present, completely or partially, in the form of oxynitrides, selected from the group consisting of titanium oxynitrides and zirconium oxynitrides; and (4) 2 to 59% by volume of a binder metal selected from low-carbon iron, low-carbon iron alloys and mixtures thereof, said sintered metal material having the following properties;

(a) a density of at least 97% of the theoretical density, relative to the theoretically possible density of the total mixed material, (b) a grain size of the sintered material phase of at most 5.5 μm, (c) a hardness (HV 30) of at least 1,200, (d) a bending fracture strength measured by the 4-point method at room temperature of at least 1,000 MPa, and (e) a fracture resistance $K_{IC}$ of at least 8.0 MPa $m^{1/2}$.

2. The sintered materials of claim 1, wherein the sintering material components (1) and (2) are titanium diboride and titanium nitride in a combined amount of 50 to 97% by volume of the total mixed material.

3. The sintered material of claim 2, wherein the combined amount of titanium diboride and titanium nitride is 50 to 90% by volume.

4. The sintered material of claim 3, wherein the combined amount of titanium diboride and titanium nitride is about 80% by volume.

5. The sintered material of claim 1, wherein titanium nitride is present in an amount of 2.5 to 40% by volume.

6. The sintered material of claim 5, wherein the oxides are present in an amount of 0.1 to 10% by volume.

7. The sintered material of claim 1, wherein the binder metal has less than 0.1% by weight of carbon.

8. The sintered material of claim 1, wherein the binder metal is a low-carbon iron alloy containing chromium or a mixture of nickel and chromium.

9. The sintered material of claim 8, wherein the low-carbon iron alloy contains chromium in an amount of about 12% by weight.

10. The sintered material of claim 8, wherein the low-carbon iron alloy contains a mixture of nickel and chromium in an amount of about 8% by weight of nickel and about 18% by weight of chromium.

11. Mixed sintered metal materials comprising:

(a) 2.5 to 40% by volume of titanium nitride;

(b) an amount of titanium diboride sufficient to provide a combined volume of titanium nitride and titanium diboride of from 50 to 90% of the total mixed sintered material;

(c) 0 to 10% by volume of oxides selected from the group consisting of titanium oxide and zirconium oxide; and (d) 2 to 59% by volume of a binder metal selected from low-carbon iron, low-carbon iron alloys and mixtures thereof, said sintered metal material having the following properties;

(1) a density of at least 97% of the theoretical density, relative to the theoretically possible density of the total mixed material, (2) a grain size of the sintered material phase of at most 5.5 μm, (3) a hardness (HV 30) of at least 1,200, (4) a bending fracture strength measured by the 4-point method at room temperature of at least 1,000 MPa, and (5) a fracture resistance $K_{IC}$ of at least 8.0 MPa $m^{1/2}$.

12. The sintered material of claim 11, wherein the combined volume of titanium nitride and titanium diboride is about 80%.

13. A process for producing a mixed sintered material having the following composition:

(a) a density of at least 97% of the theoretical density, relative to the theoretically possible density of the total mixed material;

(b) a grain size of the sintered material phase of at least 5.5 μm;

(c) a hardness (HV 30) of at least 1,200;

(d) a bending fracture strength measured by the 4-point method at room temperature of at least 1,000 MPa; and (e) a fracture resistance $K_{IC}$ of at least 8.0 MPa $m^{1/2}$.

said process comprising autogenously grinding said composition into a powdered mixture, cold-pressing and shaping the powdered mixture to obtain a green compact and sintering the green compact without pressure in a carbon-free atmosphere in the absence of oxygen at a temperature in the range of from 1350° C. to 1900° C.

14. The process of claim 13 comprising hot-isostatically recompacting the sintered green compact by means of a gaseous pressure transmission medium at a temperature of from 1200° C. to 1400° C. under a pressure of from 150 to 250 MPa.

15. The process of claim 13 comprising autogenously grinding a mixture of borides and nitrides and optionally oxides of titanium and zirconium, to obtain a fine powdered mixture, cold-pressing and shaping the fine powdered mixture to obtain a green compact, heating the green compact under a powder fill of the binder metal component in a carbon-free atmosphere to a temperature above the melting point of the metallic binder phase until the resulting molten binder metal penetrates into the porous green compact and completely seals the pores thereof.

* * * * *